US006241855B1

(12) United States Patent
Gibson et al.

(10) Patent No.: US 6,241,855 B1
(45) **Date of Patent: *Jun. 5, 2001**

(54) UPFLOW DELAYED COKER CHARGER HEATER AND PROCESS

(75) Inventors: William C. Gibson, Tulsa; Robert L. Gibson, Broken Arrow; James T. Eischen, Tulsa, all of OK (US)

(73) Assignee: Petro-Chem Development Co. Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/379,775

(22) Filed: Aug. 24, 1999

(51) Int. Cl.[7] ..... C10B 17/00; C10B 1/04; F22B 21/24

(52) U.S. Cl. ..... 202/124; 202/127; 196/117; 122/174; 122/235.14; 122/236; 122/356

(58) Field of Search ..... 208/132, 131, 208/50; 122/355, 511, 208, 235.4, 236, 174, 356; 202/124, 127; 196/117

(56) References Cited

U.S. PATENT DOCUMENTS 4,002,149 * 1/1977 Yamamoto et al. ..... 122/356
5,078,857 1/1992 Melton ..... 208/132
5,284,438 * 2/1994 McGill et al. ..... 431/9
5,656,150 * 8/1997 Reed et al. ..... 208/48 R
6,095,097 * 8/2000 Gibson et al. ..... 122/367.1

* cited by examiner

*Primary Examiner*—Bekir L. Yildirim
(74) *Attorney, Agent, or Firm*—Head, Johnson and Kachigian

(57) ABSTRACT

An improved process and article of manufacture to effectuate pressure reduction in a delayed coker charge heater's radiant heat section outlet and feedstock process coil, by upflowing coker feedstock through a single or double row, single or double fired, feedstock process coil. The innovative upflowing of coker feedstock as disclosed by the present invention allows BFW/Steam injection and vaporizing hydrocarbons to rise in the same flow direction as the coker feedstock, resulting in an enhanced mixing of fluid film and coker feedstock. Such enhanced mixing, in turn, increases heat transfer rates to the feedstock. As coker charge heater burners are commonly located in the bottom of the heater, the lower portion of the heater is typically the location of highest processing temperatures and tube side fouling. Upflowing the process coil places migrates the hottest processing section to a cooler location in the heater, and thus, contributes to conditions which reduce coking/fouling rates within the feedstock process coil, increase feedstock process coil tube life, reduce tube skin temperatures, and increase run time between decoking the interior portion of the feedstock process coil.

10 Claims, 5 Drawing Sheets

UPFLOW DELAYED COKER CHARGER HEATER AND PROCESS

REFERENCE TO PENDING APPLICATIONS

This application is not related to any pending applications.

REFERENCE TO MICROFICHE APPENDIX

This application is not referenced in any microfiche appendix.

TECHNICAL FIELD OF THE INVENTION

In general, the present invention is directed to crude oil refining. In particular, the present invention is directed to a process and article of manufacture to advance the efficiency of severe thermal cracking, or delayed coking, by introducing coker feedstock to the lower portion of a delayed coker charge heater's radiant heating section and "upflowing" such feedstock to an exiting capability located in the generally upper portion of said heater's radiant heating section.

BACKGROUND OF THE INVENTION

The present invention can be best understood and appreciated by undertaking a brief review of the crude oil distillation process, and most particularly, the role delayed coking plays within that process.

In its unrefined state, crude oil is of little use. In essence, crude oil (a.k.a. hydrocarbon) is a complex chemical compound consisting of numerous elements and can. Such impurities can include, but are not limited to sulfur, oxygen, nitrogen and various metals that must be removed during the refining process.

Refining is the separation and reformation of a complex chemical compound into desired hydrocarbon products. Such product separation is possible as each of the hundreds of hydrocarbons comprising crude oil possess an individual boiling point. During refining, or distillation, crude oil feedstock temperature is raised to a point where boiling begins (a.k.a. "initial boiling point, or "IBP") and continues as the temperature is increased. As the boiling temperature increases, the butane and lighter fraction of crude oil are first distilled. Such distillation begins at IBP and terminates slightly below 100° F. The fractions boiling through this range are represented and referred to as the "butanes and lighter cut."

The next fraction, or cut, begins slightly under 100° F. and terminates at approximately 220° F. This fraction is represented and referred to as straight run gasoline. Then, beginning at 220° F. and continuing to about 320° F. the Naphtha cut occurs, and is followed by the kerosene and gas/oil cuts, occurring between 320° F. and 400° F., and 450° F. to 800° F., respectfully. A term-of-art "residue cut" includes everything boiling above 800° F.

The residue cut possesses comparatively large volumes of heavy materials and two fundamental processes are employed to convert appreciable amounts of such residuals to lighter materials—thermal cracking and delayed coking. While thermal-cracking may be properly considered "the use of heat to split heavy hydrocarbon into its lighter constituent components," delayed coking should be considered "severe thermal cracking" and occurs within a coke drum after a coker feedstock has been heated in an apparatus referred to as a coking heater, or "delayed coker charge heater." An improved delayed coker charge heater and process serve as the focus of the instant invention.

Delayed coking processes and heaters are well known in the art and have been discussed and disclosed, for example, in U.S. Pat. No. 5,078,857, invented by M. Shannon Melton and issued Jan. 7, 1992 (hereafter referred to as "Melton"). Melton and prior art references cited herein are hereby provided to disclose and distinguish said art from the novel improvements embodied and afforded by the instant invention.

Today, delayed coker charge heaters are required to address service demands far more severe than in times past. Such demands typically include reduced recycling rates, heavier processing fluids (a.k.a. "coker feedstock"), and increases in undesirable processing fluid components, such as, but not limited to, asphaltine content, inerts, metals, salts, etc. Increased fresh feed charge rates and the afore stated demands result in a commensurate increase in fouling/coking rates within the interior portions of a coker heater's processing coil or heating conduit. Increased fouling rates, in turn, increase occurrences of coker "down time" to decoke fouled processing coils. Coker charge heaters as represented within the present art have failed to adequately address the afore stated problems. The present invention, by disclosing a novel and unique processing design and methodology, addresses such increased service demands and obviates many of the deficiencies represented in the present art.

Accordingly, the present invention is directed to an improved process and article of manufacture to advance the performance efficiency and life cycle of delayed coker charge heaters by introducing coker feedstock to the lower portion of a delayed coker charge heater and "upflowing" such feedstock to an exiting capability located in the generally upper portion of said coker charge heater's radiant heating section.

BRIEF SUMMARY OF THE INVENTION

The present invention provides for an improved method and article of manufacture for greatly improving upon coker charge heater performance and component longevity by introducing coker feedstock to the lower portion of a delayed coker charge heater and "upflowing" such feedstock through a heating conduit (a.k.a. "process coil") to an exiting outlet located in the generally upper portion of said coker charge heater's radiant heating section.

The "upflowing" of a coker charge heater's process fluid permits enhanced stripping and shredding of fluid film from the interior portion of the coker's heating conduit wall, and mixes such film with the process fluid. This enhanced mixing cools the resultant fluid film, increases interior heat transfer rates, cools process coil tube metals and reduces coking/fouling rates within the interior portion of the process coil. These benefits result directly from lower pressures, enhanced vaporization and mixing introduced to delayed coker processing by way of upflowing coker feedstock through a process coil located in the coker's radiant heating section.

Consequently, it is an objective of the instant invention to reduce delayed coker charge heater outlet pressure, thereby providing for an associated reduction in the fouling rate of the interior portion of a delayed coker heater's process coil, or heating conduit.

It is another objective of the instant invention to migrate the hottest part of the process coil, and least able to accommodate elevated radiant flux rates, to the generally upper portion of a delayed coker charge heater's radiant heat section.

It is a further objective of the instant invention to cause enhanced shredding of feedstock film from the interior of the heating conduit wall and mix such film with the process fluid resulting in a cooler fluid film, an increase in interior heat transfer rates, and cooler process coil tube metals. Such effects further reducing coking/fouling rates within the interior portion of the process coil.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is clear that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

Figure 2:
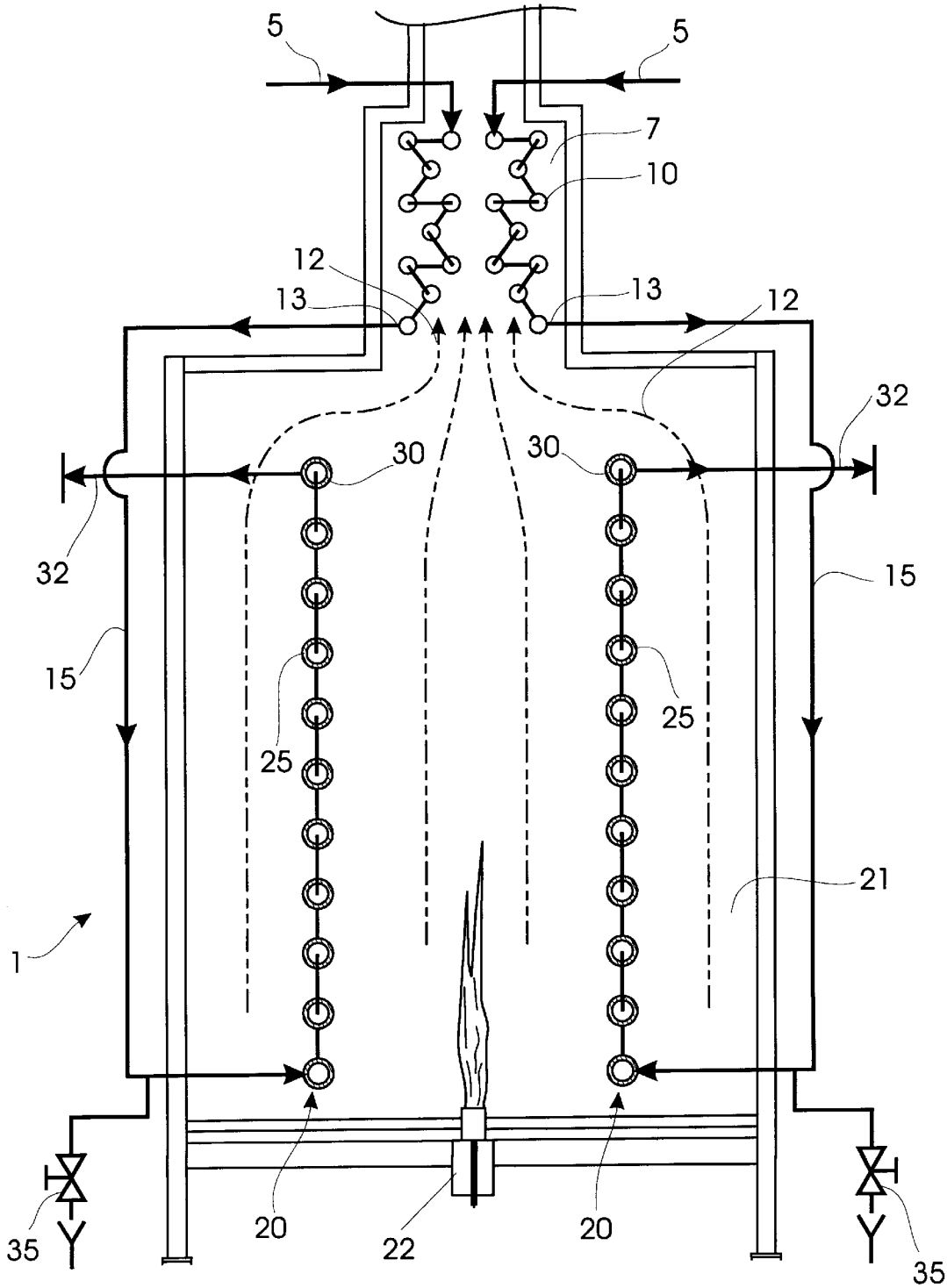
FIG. 2 is an illustration of the invention's preferred embodiment, represented as a single row, single fired delayed coker charge beater.

Referring now to the drawings in detail, FIG. 2 illustrates the invention's upflow delayed coker charge heater preferred embodiment. The upflow delayed coker charge heater 1 is comprised of two heating sections, a first heating section 7 to introduce convection heat to coker feed stock (synonymously referred to as "process fluid") by way of a containment vehicle, typically heat resistant metallic tubing 10, and a second heating section 21 which further heats such feed stock, or process fluid, by predominantly radiant heating means.

At system start up the upflow delayed coker charge burners 22 are engaged and the heater 1 is warmed to an appropriate operating temperature to allow for the introduction of delayed coker feedstock, or process fluid. Said feed stock typically recovered from a previous vacuum tower distillation process then enters the upflow delayed coker charge heater 1 by way of a first heating section inlet 5 and descends via containment tubes 10 throughout the first heating section 7 in a zig-zag manner in a direction counter to the normal "bottom-up" flow of flue gas 12 occurring within the said first heating section 7. The coker feed stock next exits the first heating section 7 by way of a first heating section outlet 13 located in the generally lower portion of the first heating section 7.

Having traversed the delayed coker charge heater's first heating section 7, the coker feed stock next enters into the heaters second section 21. Entrance into the heaters second heating section 21 is facilitated by the invention's convection to radiant cross over conduit 15 and a second heating section inlet 20. The instant invention convection to radiant cross over conduit 15 is typically, though not limitedly, a heat resistant, metallic tubular structure consistent in diameter and construction to that manifested by invention's second heating section's heating conduit 25. The invention's second heating section inlet 20 facilitates the connection of the invention's convection to radiant cross over conduit 15 and second heating section's heating conduit 25. Pressure, introduced by a pumping capacity external to the upflow delayed coker charged heater 1 facilitates travel through the coker charged heater 1 internal heating conduit 25 in an upward direction until said coker feed stock contained within said heating conduit 25 reaches a second heating unit outlet 30 located in the generally uppermost portion of the second heating section 21. The coker feed stock then exits the second heating section 21 through the second heating section's outlet 30 whereupon it is delivered to a coke drum for completion of the delayed coking process. The afore stated description discloses the present invention with respect to a single row, single fired delayed coker design while FIGS. 3 describes an alternative embodiment of the present invention.

Figure 1:
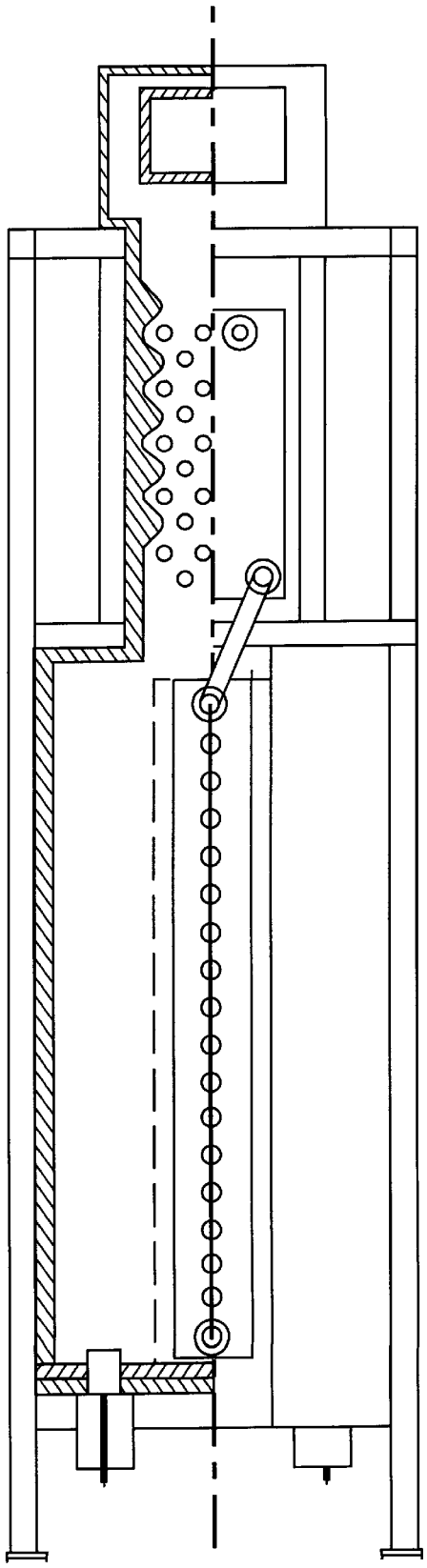
FIG. 1 PRIOR ART
FIG. 1 is a prior art illustration depicting a typical single row coker heater as represented by the present art.
Figure 3:
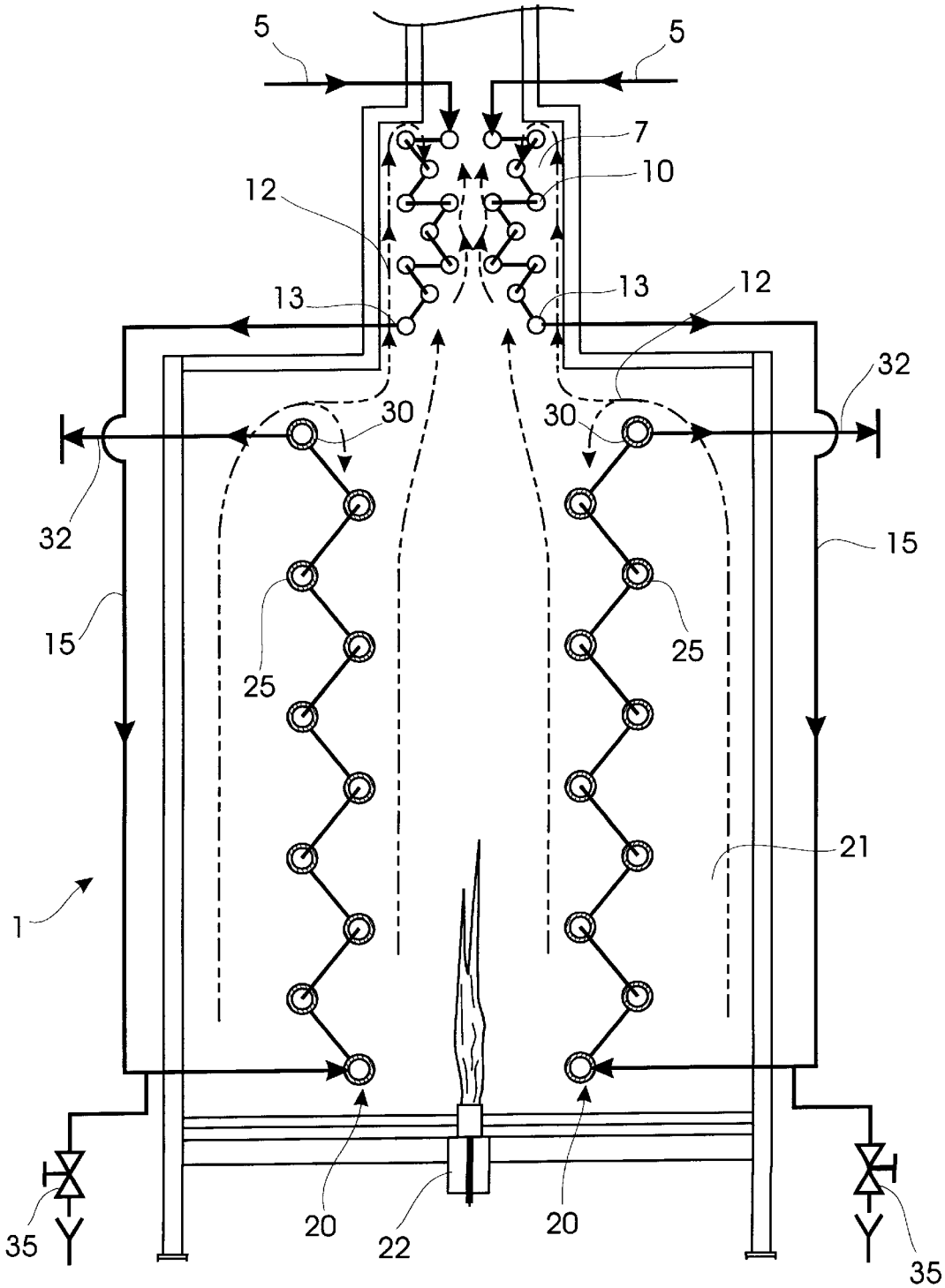
FIG. 3 is an alternative embodiment illustration of the instant invention, represented as a double row, single fired delayed coker charge heater.

FIG. 3 illustrates an alternative embodiment of the instant invention represented as a double row, single fired delayed coker charge heater 1. In this, and remaining alternative embodiments of the invention herein described, coker feedstock is introduced and processed in accordance with the coker feedstock flow described in association with FIG. 1. That is, feed stock first enters the double row, single fired delayed coker charge heater 1 illustrated in FIG. 3, by way of a first heating section inlet 5 and descends via containment tubes 10 throughout the first heating section 7 in a zig-zag manner in a direction counter to the normal "bottom-up" flow of flue gas 12 occurring within the said first heating section 7. The coker feed stock next exits the first heating section 7 by way of a first heating section outlet 13 located in the generally lower portion of the first heating section 7. Having traversed the double row, single fired delayed coker charge heater first heating section 7, the coker feed stock next enters into said heaters second heating section 21. Entrance into said heating section 21 is facilitated by the invention's convection to radiant cross over conduit 15 and a second heating section inlet 20. The instant invention convection to radiant cross over conduit 15 is typically, though not limitedly, a heat resistant, metallic tubular structure consistent in diameter and construction to that manifested by invention's second heating section's serpentine coil 25. The invention's second heating section inlet 20 facilitates the connection of the invention's convection to radiant cross over conduit 15 and second heating section's serpentine coil 25. Pressure, introduced by a pumping capacity external to the double row, single fired delayed coker charge heater 1 facilitates coker feedstock transport through the coker charged heater internal heating conduit 25 in an upward direction until said coker feed stock contained within said heating conduit 25 reaches a second heating unit outlet 30 located in the generally uppermost portion of the second heating section 21. The coker feed stock then exits the second heating section 21 through said second heating section's outlet 30 whereupon it is delivered to a coke drum for completion of the delayed coking process.

Figure 4:
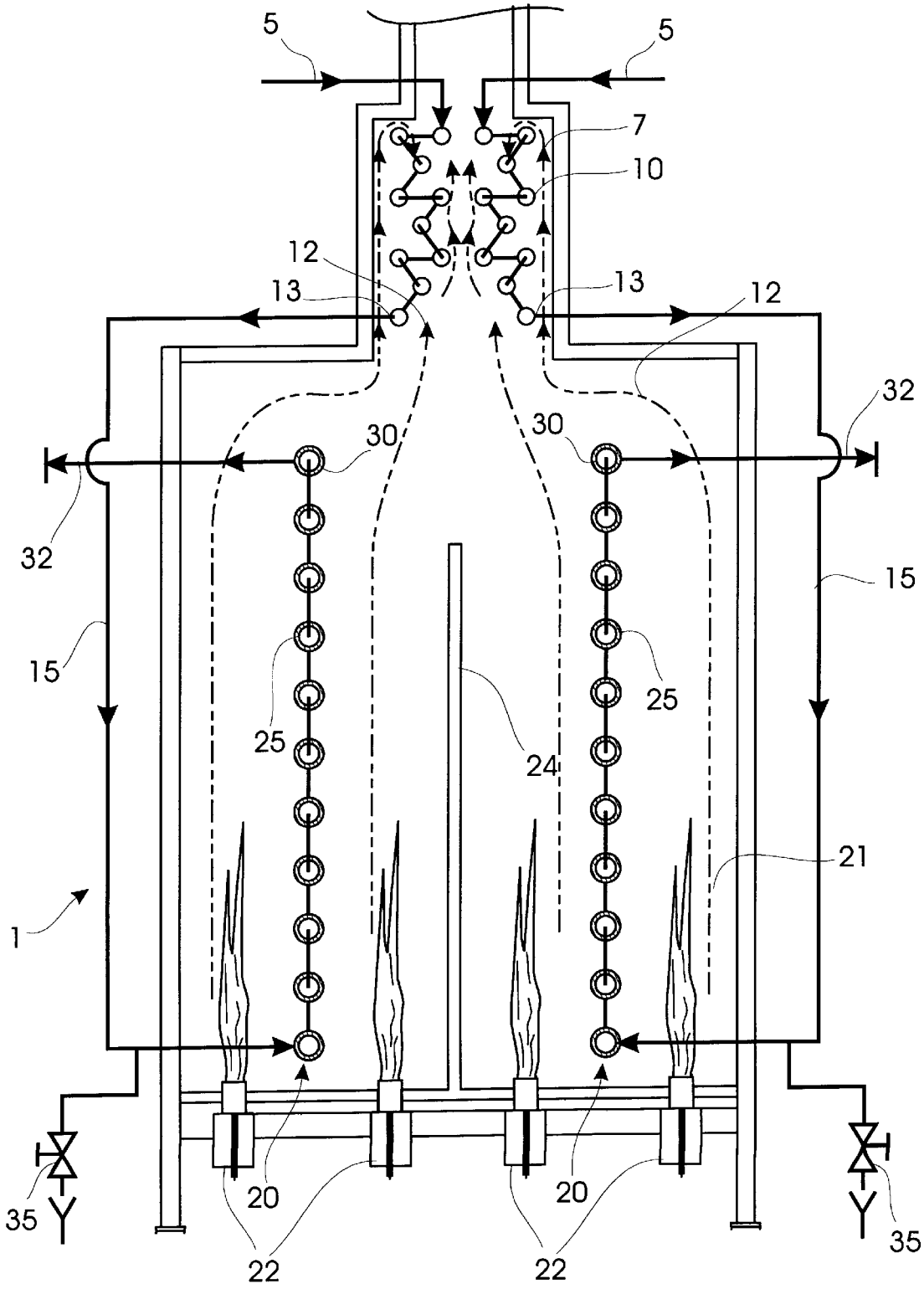
FIG. 4 is an alternative embodiment illustration of the instant invention represented as a single row, double fired delayed coker charge heater.

FIG. 4 illustrates an alternative embodiment of the instant invention when represented as a single row, double fired delayed coker charge heater. In this, and remaining alternative embodiments of the invention herein described, coker feedstock is introduced and processed in accordance with the coker feedstock processing flow as described in association with FIG. 2.

Figure 5:
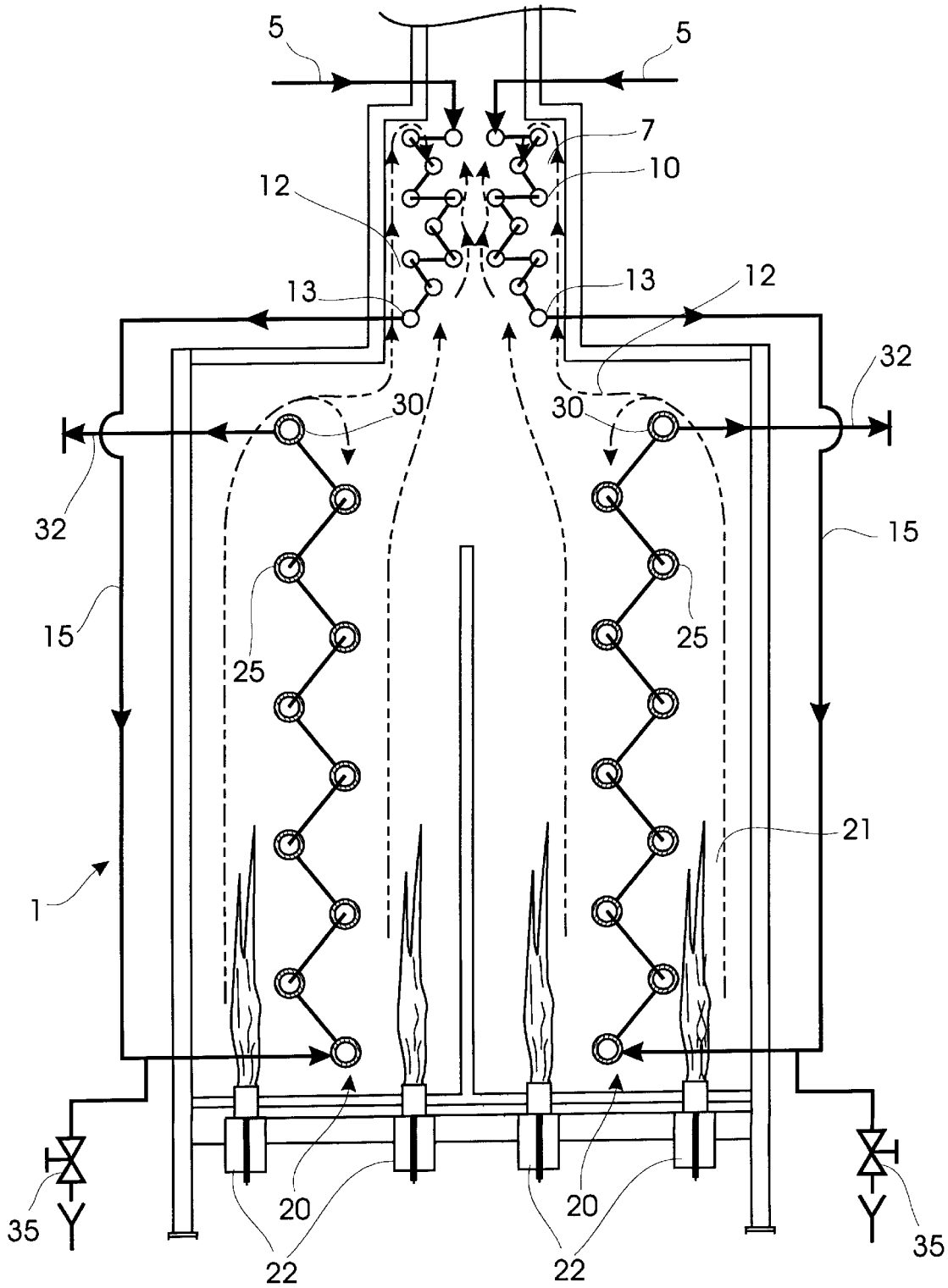
FIG. 5 is an alternative embodiment illustration of the instant invention represented as a double row, double fired delayed coker charge heater.

FIG. 5 illustrates an alternative embodiment of the instant invention when represented as a double row, double fired delayed coker charge heater. In this embodiment of the invention, coker feedstock is introduced and processed in accordance with the coker feedstock processing flow as described in association with FIG. 3.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A delayed coker charge heater for heating a coker feedstock comprising:

a first heating section providing convective heat to said coker feedstock;

a second heating section adjacent to said first heating section, said second heating section having an upper half and bottom half which provide radiant heat to said feedstock;

a convection to radiant crossover connecting said first heating section and said second heating section via a second heating section feedstock inlet located generally in said bottom half of said second heating section and a first heating section outlet located generally in the lower portion of said first heating section:

a horizontal feedstock heating conduit positioned within said second heating section to allow the upward flow of feedstock within said conduit;

a second heating section outlet located generally in said upper half of said second heating section;

a plurality of burners located generally in a lower portion of said second heating section, said burners positioned direct flame upwardly within said second heating section along a plane generally parallel to said horizontal heating conduit.

2. A heater according to claim 1 wherein said heating conduit further comprises a plurality of single row heating conduits.

3. A heater according to claim 2 wherein said burners are positioned so as to be capable of providing and directing flame upwardly within a generally centered portion of said second heating section, said flame directed along a plane generally parallel to and between said plurality of single row heating conduits.

4. A heating conduit according to claim 3 wherein burners are located generally in a lower portion of said second heating section, said burners positioned on opposite sides of said conduits so as to be capable of providing and directing flame upwardly on said opposite sides of said conduits, said flame directed along a plane generally parallel to said plurality of single row heating conduits.

5. A heater according to claim 1 wherein said heating conduit is a double row heating conduit.

6. A heating conduit according to claim 5 wherein said heating conduit further comprises a plurality of double row heating conduits.

7. A heating conduit according to claim 6 wherein said burners are positioned so as to be capable of providing and directing flame upwardly within a generally centered portion of said second heating section, said flame directed along a plane generally parallel to and between said plurality of double row heating conduits.

8. A heating conduit according to claim 6 wherein burners are located generally in a lower portion of said second heating section, said burners positioned on opposite sides of said conduits so as to be capable of providing and directing flame upwardly on said opposite sides of said conduits, said flame directed in a plane generally parallel to said plurality of double row heating conduits.

9. A heater according to claim 1 wherein said heating conduit is of tubular construction, said tubular construction comprising a generally horizontal and reciprocating path of continuous tubing extending from an inlet in the lower portion of said heating section upwardly to an outlet located in upper portion of said second heating section.

10. A heater according to claim 9 wherein a plurality of portions of the tubing of said double row heating conduit are generally represented as a serpentine coiled.

* * * * *